US010982925B2

(12) United States Patent
Taylor et al.

(10) Patent No.: US 10,982,925 B2
(45) Date of Patent: Apr. 20, 2021

(54) RUST-RETARDANT SNAP CAP

(71) Applicant: Process4, Inc., Chagrin Falls, OH (US)

(72) Inventors: Curtis Taylor, Chagrin Falls, OH (US); Matthew Hanson, Chagrin Falls, OH (US)

(73) Assignee: Process4, Inc., Chagrin Falls, OH (US)

( * ) Notice: Subject to any disclaimer, the term of this patent is extended or adjusted under 35 U.S.C. 154(b) by 0 days.

(21) Appl. No.: 16/506,132

(22) Filed: Jul. 9, 2019

(65) Prior Publication Data

US 2020/0096282 A1 Mar. 26, 2020

Related U.S. Application Data

(60) Provisional application No. 62/828,527, filed on Apr. 3, 2019, provisional application No. 62/696,567, filed on Jul. 11, 2018.

(51) Int. Cl.
*F41A 29/00* (2006.01)

(52) U.S. Cl.
CPC ..... *F41A 29/00* (2013.01)

(58) Field of Classification Search
CPC ..... F41A 29/00; F41A 35/02
USPC ..... 42/95, 96; 224/243; 203/317
See application file for complete search history.

(56) References Cited

U.S. PATENT DOCUMENTS

| | | | | |
|---|---|---|---|---|
| 2,465,163 A * | 3/1949 | Lockwood | F41A 29/00 42/96 |
| 3,849,923 A * | 11/1974 | Hawkins | F41A 29/00 42/96 |
| 4,100,693 A * | 7/1978 | Cech | F41A 17/44 42/96 |
| 6,708,438 B1 * | 3/2004 | Sorensen | F41A 29/00 42/70.11 |

* cited by examiner

*Primary Examiner* — Samir Abdosh
(74) *Attorney, Agent, or Firm* — Ulmer & Berne LLP; Brian Turung; Eric Robbins

(57) ABSTRACT

Snap cap devices configured to be inserted within an associated firearm are disclosed. The exemplary snap cap devices are made from or otherwise include a material configured to release corrosion protection molecules.

21 Claims, 9 Drawing Sheets

RUST-RETARDANT SNAP CAP

The present disclosure claims priority on U.S. Patent Application Ser. Nos. 62/696,567 filed Jul. 11, 2018 and 62/828,527 filed Apr. 3, 2019, which are incorporated herein by reference.

The present disclosure is directed to snap cap devices configured to be inserted within an associated firearm and which are made from or otherwise include a material configured to release corrosion protection molecules.

BACKGROUND ON THE INVENTION

Snap caps are known devices that are shaped like a standard firearm cartridge but contain no primer, propellant, or projectile. Snap caps generally serve the same function as dummy rounds, but are different in that dummy rounds are usually made from a real cartridge having its propellant and primer removed but retaining the projectile and casing, while snap caps are designed to be 'fake' cartridges from the outset. Snap caps are known to be used to ensure that dry-firing of certain firearm designs does not cause stress and/or impact damage to the firing pin and/or the barrel breech. However, conventional snap caps, especially when fully or partially formed of a metal, can contribute to or not inhibit or prevent corrosion, rust, and/or tarnish when inserted into firearms and firearm components, which firearms and firearm components are commonly made from metal.

In view of the prior art, there remains a need for improved snap cap devices that include one or more components and/or structural features that provide a material which helps protect against rust, corrosion, and tarnishing.

BRIEF DESCRIPTION OF THE INVENTION

The present disclosed is directed to the use of one or more corrosion protective components to inhibit or prevent corrosion of a firearm.

In one non-limiting aspect of the present disclosure, one or more corrosion protective components can be in the form of a snap cap device that is configured to be inserted in an associated firearm and configured to be made from or otherwise include a protective material configured to release corrosion protection molecules.

In another and/or alternative non-limiting aspect of the present disclosure, there is provided a snap cap device that provides oxidation and/or corrosion protection to a firearm. In one non-limiting embodiment, the snap cap includes a body portion, an internal cavity and a protective material that is formed of or includes a material that releases corrosion protection molecules.

In another and/or alternative non-limiting aspect of the present disclosure, there is provided a snap cap device that provides oxidation and/or corrosion protection to a firearm, wherein the snap cap is configured to be at least partially inserted within a barrel, magazine, chamber, etc. of a firearm and to provide protection against corrosion, tarnish, and/or rust.

In another and/or alternative non-limiting aspect of the present disclosure, there is provided a snap cap device that provides oxidation and/or corrosion protection to a firearm, wherein the snap cap device includes a snap cap body that extends between a first end and a second end of the snap cap device. The first end of the snap cap body is configured to be inserted within the barrel, magazine, chamber, etc. of an associated firearm. The second end of the snap cap body is configured to be disposed adjacent a firing pin of the associated firearm when the first end has been inserted in the barrel, magazine, or chamber. In one non-limiting embodiment, the snap cap body is configured to rest in the portion of a firearm where ammunition, such as, for example, a bullet or a shotgun shell, is disposed immediately before firing the firearm. The snap cap body is generally formed of a durable material (e.g., plastic, metal, wood, ceramic, composite material, etc.). The snap cap body can be formed of a single material or be formed of multiple materials. The snap cap body can be formed as a single piece or as multiple pieces.

In another and/or alternative non-limiting aspect of the present disclosure, there is provided a snap cap device that provides oxidation and/or corrosion protection to a firearm, wherein the snap cap is generally cylindrical in shape; however, the particular shape of the snap cap body is non-limiting.

In another and/or alternative non-limiting aspect of the present disclosure, there is provided a snap cap device that provides oxidation and/or corrosion protection to a firearm, wherein the snap cap body includes a hollow interior region or cavity. In one non-limiting embodiment, the cavity is accessible through an opening in the first end of the snap cap body.

In another and/or alternative non-limiting aspect of the present disclosure, there is provided a snap cap device that provides oxidation and/or corrosion protection to a firearm, wherein the snap cap body includes an end wall that is disposed at the second end such that when the snap cap body is inserted into an associated firearm, the end wall generally faces the firing pin of the associated firearm. In one non-limiting embodiment, the end wall can optionally include a strike wall component configured to receive the impact force of the firing pin during a dry-firing event. The strike wall component (when used) can be a spring-buffered or made from a rubber or soft polymer material to help absorb the impact force from the firing pin during dry-firing. The strike wall component can be formed of the same or different materials from the snap cap body. Generally, the strike wall component is located in a central region of the end wall.

In another and/or alternative non-limiting aspect of the present disclosure, there is provided a snap cap device that provides oxidation and/or corrosion protection to a firearm, wherein the second end of the snap cap body can optionally include one or more flanges or a stop wall disposed fully or partially around the exterior perimeter of the snap cap body. In one non-limiting embodiment, the one or more flanges or stop wall are radially disposed around a circumference of the cylindrical snap cap body. The one or more flanges or stop wall can protrude outward from/parallel to the end wall and outward from/perpendicular to the cylindrical walls of the snap cap body; however, this is not required. The one or more flanges or stop wall can be formed an approximate 90° angle with regard to the central longitudinal axis of the snap cap body. The stop wall can have a cross-sectional area that is greater than a cross-sectional area of the region of the snap cap body that is positioned adjacent to the end wall. The one or more flanges or stop wall is generally configured to rest against at least a portion of the barrel, magazine, or chamber of an associated firearm in which the snap cap body is disposed, thereby maintaining the end wall in adjacent relation to the firing pin of the associated firearm and preventing the snap cap body from sliding down into an unwanted area of the barrel, magazine, or chamber; however, such a configuration is non-limiting.

In another and/or alternative non-limiting aspect of the present disclosure, there is provided a snap cap device that provides oxidation and/or corrosion protection to a firearm, wherein the snap cap body includes one or more surface on the exterior surface wall. In one non-limiting embodiment, the one or more surface features can include one or more grooves. The one or more grooves, when included in the snap cap body, can extend a longitudinal length of the snap cap body. In one non-limiting configuration, the one or more grooves extend the entire longitudinal length of the snap cap body; however, such a configuration is non-limiting. The one or more grooves be substantially straight; however, this is not required (e.g., curved, helical shape, etc.).

In another and/or alternative non-limiting aspect of the present disclosure, there is provided a snap cap device that can be fully or partially formed of or include a protective material that releases corrosion protection molecules (e.g., volatile corrosion inhibitors (VCIs), vapor phase inhibitors (VPIs), etc.). Non-limiting VCI materials include VCI petroleum-based coating (e.g., blend of oxidized petrolatum, calcium salts, petroleum sulfonate, amine carboxylates, mineral spirits), VCI latex coating (e.g., acrylic latex, calcium salt of organo-sulfonic acid, and amine carboxylates), VCI solvent-based epoxy (e.g., bisphenol A epoxy with aliphatic amine, oxidized petrolatum, calcium salts, petroleum sulfonates, amine carboxylates, and mineral spirits), VCI-modified water-based alkyds (e.g., EPS 2601 alkyd, calcium salt of an organo-sulfonic acid, and an amino carboxylate), water-based alkyd (e.g., EPS 2601), zinc-rich epoxy primer (e.g., bisphenol A, aliphatic amine, zinc pigment, 3921 epoxy). Commercially available VCIs are offered by Lowes, Cabalas, Flambeau, Kobalt, etc. Exemplary raw materials having the vapor corrosion inhibiting substance are commercially available from Zerust®.

In another and/or alternative non-limiting aspect of the present disclosure, there is provided a snap cap device that includes snap cap body that is formed of a material that includes the protective material. For example, the material can be a mixture of protective material and polymer material (e.g., polypropylene, resin, polyurethane, silicon, etc.). In one non-limiting example, the material includes 60-99.9 wt. % polymer (and all values and ranges therebetween) and 0.1-40 wt. % protective material (and all values and ranges therebetween), typically 70-99.5 wt. % polymer and 0.5-30 wt. % protective material, and more typically 80-99.5 wt. % polymer (and all values and ranges therebetween) and 0.5-20 wt. % protective material. When the snap cap body is formed of a material that includes the protective material, the corrosion protection molecules from the protective material can release (e.g., continuously release) over time from the material.

In another and/or alternative non-limiting aspect of the present disclosure, there is provided a snap cap device that includes snap cap body wherein powder, one or more pellets, and/or plugs of a material that includes or is formed of the protective material can be inserted into the cavity in the snap cap body. In such an arrangement, a stopper or plug can be inserted through an opening in the first end of the snap cap body. In this arrangement, the stopper or plug can be porous or permeable to the corrosion protection molecules so as to allow the corrosion protection molecules to escape from the cavity through the stopper or plug. As can be appreciated, the snap cap body can include one or more openings in the side wall of the snap cap body, and/or second end wall to also or alternatively allow the corrosion protection molecules to escape from the cavity though the one or more openings in the side wall of the snap cap body and/or second end wall. As can also be appreciated, the strike wall component (when used) can include one or more openings and/or be porous or permeable to the corrosion protection molecules so as to allow the corrosion protection molecules to escape from the cavity through the strike wall component.

In another and/or alternative non-limiting aspect of the present disclosure, there is provided a snap cap device that includes snap cap body that is formed of a material that is absent a protective material. In such an arrangement, powder, one or more pellets, and/or plugs of a material that includes or is formed of the protective material are inserted into the cavity in the snap cap body. In such an arrangement, a stopper or plug can be inserted through an opening in the first end of the snap cap body. In this arrangement, the stopper or plug can be porous or permeable to the corrosion protection molecules so as to allow the corrosion protection molecules to escape from the cavity through the stopper or plug. As can be appreciated, the snap cap body can include one or more openings in the side wall of the snap cap body, and/or second end wall (e.g., vent holes, etc.) to also or alternatively allow the corrosion protection molecules to escape from the cavity though the one or more openings in the side wall of the snap cap body and/or second end wall. As can also be appreciated, the strike wall component (when used) can include one or more openings and/or be porous or permeable to the corrosion protection molecules so as to allow the corrosion protection molecules to escape from the cavity through the strike wall component.

In another and/or alternative non-limiting aspect of the present disclosure, there is provided a snap cap device that includes snap cap body can include a barrier film infused or impregnated with the protective material. The film (when used) can cover one or more portions or all of the exterior surface of the snap cap body. In one non-limiting example, the film can be made a polymer or plastics such as, but not limited to, low-density polyethylene (LDPE) or metals such as aluminum.

In another and/or alternative non-limiting aspect of the present disclosure, there is provided a snap cap device that includes a snap cap body that can include a coating that includes the protective material. The coating (when used) can cover one or more portions or all of the exterior surface of the snap cap body. The coating can be at least partially formed of a polymer, silicone, polyurethane, etc.; however, this is not required.

In another and/or alternative non-limiting aspect of the present disclosure, there is provided a snap cap device that includes a snap cap body and a snap cap base, wherein the snap cap body extends from the snap cap base. The first end of the snap cap body is configured to be inserted within the barrel, magazine, chamber, etc., of a firearm. The second end of the snap cap base is configured to be connected to the first end of the snap cap base. The snap cap base includes a second end and is configured to be disposed adjacent a firing pin of the firearm when the snap cap body is inserted in the barrel, magazine, or chamber of a fire arm. The second end of the snap cap base can optionally include a strike wall component to receive the impact force of the firing pin during a dry-firing event. In one non-limiting arrangement, the snap cap body and the snap cap base can be formed of the same or different materials. In one specific example, the base is formed of a metal material and the snap cap body is formed of a polymer, silicon, resin and/or urethane material that maty or may not include the protective material. The snap cap body and/or snap cap base can include a connection arrangement that forms a permanent or temporary connection between the snap cap body and snap cap base. In one non-limiting embodiment, the second end of the snap cap base can include one or more flanges or stop wall that is configured to rest against at least a portion of the barrel, magazine, or chamber of an associated firearm in which the snap cap is disposed, thereby maintaining the end wall in adjacent relation to the firing pin of the firearm, thereby inhibiting or preventing the snap cap from sliding down into an unwanted area of the barrel, magazine, or chamber of the firearm.

It is one non-limiting object of the present disclosure to provide a snap cap device configured to release corrosion protection molecules to protect a firearm. The snap cap device comprises a snap cap body. The snap cap body includes a first and a second end. The first end is configured to be inserted into a barrel or chamber of a firearm. The second end includes a flange or wall that is configured to inhibit or prevent the second end from being fully inserted into the barrel or chamber of the firearm. The snap cap device includes a protective material that includes or is formed of a material that releases the corrosion protection molecules. The protective material is a) included in a material used to at least partially form the snap cap body, b) included in and/or on a film material that is secured to one or more portions the snap cap body, c) included in a coating material that is coated on one or more portions of the snap cap body, d) inserted into a cavity in the snap cap body, and/or e) included in a material used to at least partially form a plug that is connected to the snap cap body.

It is another non-limiting object of the present disclosure to provide a snap cap device wherein the snap cap body has a length that is greater than a width of the snap cap body.

It is another non-limiting object of the present disclosure to provide a snap cap device wherein the snap cap body includes a surface feature on an exterior surface wall of the snap cap body. The surface feature includes a recess portion or groove that extends 50-100% a longitudinal length of said snap cap body.

It is another non-limiting object of the present disclosure to provide a snap cap device wherein a second end of the snap cap body includes an opening that includes a strike wall component.

It is another non-limiting object of the present disclosure to provide a snap cap device wherein the snap cap body further comprises one or more surface features on an exterior surface wall.

It is another non-limiting object of the present disclosure to provide a snap cap device wherein a second end of the snap cap body includes one or more openings.

It is another non-limiting object of the present disclosure to provide a snap cap device further including a plug. The snap cap body includes a cavity that is connected to a first end opening located at a first end of the snap cap body. The plug is connected to the first end. The protective member can be in the form of a powder, pellet and/or plug that is located in the cavity and at least partially retained in the cavity by the plug.

It is another non-limiting object of the present disclosure to provide a snap cap device wherein the plug is threadedly connected to the first end.

It is another non-limiting object of the present disclosure to provide a snap cap device wherein the plug includes one or more openings.

It is another non-limiting object of the present disclosure to provide a snap cap device wherein the snap cap body includes an upper cap body that is connected to a snap cap base. The upper cap body is formed of a different material from the snap cap base.

It is another non-limiting object of the present disclosure to provide a snap cap device wherein the snap cap body is irremovably connected to the snap cap base.

It is another non-limiting object of the present disclosure to provide a snap cap device wherein the snap cap body includes a time indicator arrangement. The time indicator arrangement includes a time indicator panel.

It is another non-limiting object of the present disclosure to provide a snap cap device wherein the time indicator arrangement includes a recess portion in the snap cap body and a time indicator panel. The time indicator panel includes time information in the form of date information and/or seasonal information.

It is another non-limiting object of the present disclosure to provide a method for reducing oxidation and/or corrosion of a firearm. The method includes providing a snap cap device that is configured to release corrosion protection molecules to protect a firearm. The snap cap device comprises a snap cap body. The snap cap body includes a first and a second end. The first end is configured to be inserted into a barrel or chamber of a firearm. The second end includes a flange or wall configured to inhibit or prevent the second end from being fully inserted into the barrel or chamber of the firearm. The snap cap device includes a protective material that includes or is formed of a material that releases the corrosion protection molecules. The protective material is a) included in a material used to at least partially form the snap cap body, b) included in and/or on a film material that is secured to one or more portions the snap cap body, c) included in a coating material that is coated on one or more portions of the snap cap body, d) inserted into a cavity in the snap cap body, and/or e) included in a material used to at least partially form a plug that is connected to the snap cap body. The method includes at least partially inserting the snap cap device into the barrel or chamber of the firearm and enabling corrosion protection molecules from the protective material to protect the firearm.

It is another non-limiting object of the present disclosure to provide a method for reducing oxidation and/or corrosion of a firearm wherein the snap cap body includes a surface feature on an exterior surface wall of the snap cap body. The surface feature includes a recess portion or groove. The method further includes the step of enabling the corrosion protection molecules to flow about the exterior surface wall and along the surface feature so that the corrosion protection molecules can flow from both ends of the snap cap body.

It is another non-limiting object of the present disclosure to provide a method for reducing oxidation and/or corrosion of a firearm wherein a second end of the snap cap body includes an opening that includes a strike wall component.

It is another non-limiting object of the present disclosure to provide a method for reducing oxidation and/or corrosion of a firearm wherein a second end of the snap cap body includes one or more openings.

It is another non-limiting object of the present disclosure to provide a method for reducing oxidation and/or corrosion of a firearm further including a plug. The snap cap body includes a cavity that is connected to a first end opening located at a first end of the snap cap body. The plug is connected to the first end. The protective member can be in the form of a powder, pellet and/or plug. The protective material can be located in the cavity and at least partially retained in the cavity by the plug.

It is another non-limiting object of the present disclosure to provide a method for reducing oxidation and/or corrosion of a firearm wherein the plug is threadedly connected to the first end.

It is another non-limiting object of the present disclosure to provide a method for reducing oxidation and/or corrosion of a firearm wherein the snap cap body includes an upper cap body that is connected to the snap cap base. The upper cap body can be formed of a different material from the snap cap base.

It is another non-limiting object of the present disclosure to provide a method for reducing oxidation and/or corrosion of a firearm wherein the snap cap body includes a time indicator arrangement. The time indicator arrangement can include a time indicator panel.

It is another non-limiting object of the present disclosure to provide a method for reducing oxidation and/or corrosion of a firearm wherein the time indicator arrangement includes a recess portion in the snap cap body and a time indicator panel. The time indicator panel includes time information in the form of date information and/or seasonal information.

It is another non-limiting object of the present disclosure to provide a method for reducing oxidation and/or corrosion of a firearm further including the step of punching openings in the time indicator panel to indicate a time period that the snap cap device was used with the firearm.

These and other advantages will become apparent from the discussion of the distinction between the invention and the prior art and when considering the preferred embodiment shown in the accompanying drawings.

BRIEF DESCRIPTION OF THE DRAWINGS

Reference may now be made to the drawings, which illustrate various embodiments that the invention may take in physical form and in certain parts and arrangements of parts wherein:

FIGS. 1A-1B and 3A-3B illustrate and show a snap cap device configured to be inserted in an associated firearm and to be made from or otherwise include a material configured to release corrosion protection molecules, and FIG. 3C pictures the snap cap device of FIGS. 1A-1B and 3A-3B in an inserted configuration with an associated firearm.

FIGS. 2A and 2B show another snap cap device configured to be inserted in an associated firearm and configured to be made from or otherwise include a material configured to release corrosion protection molecules.

DETAILED DESCRIPTION

Figure 1A:
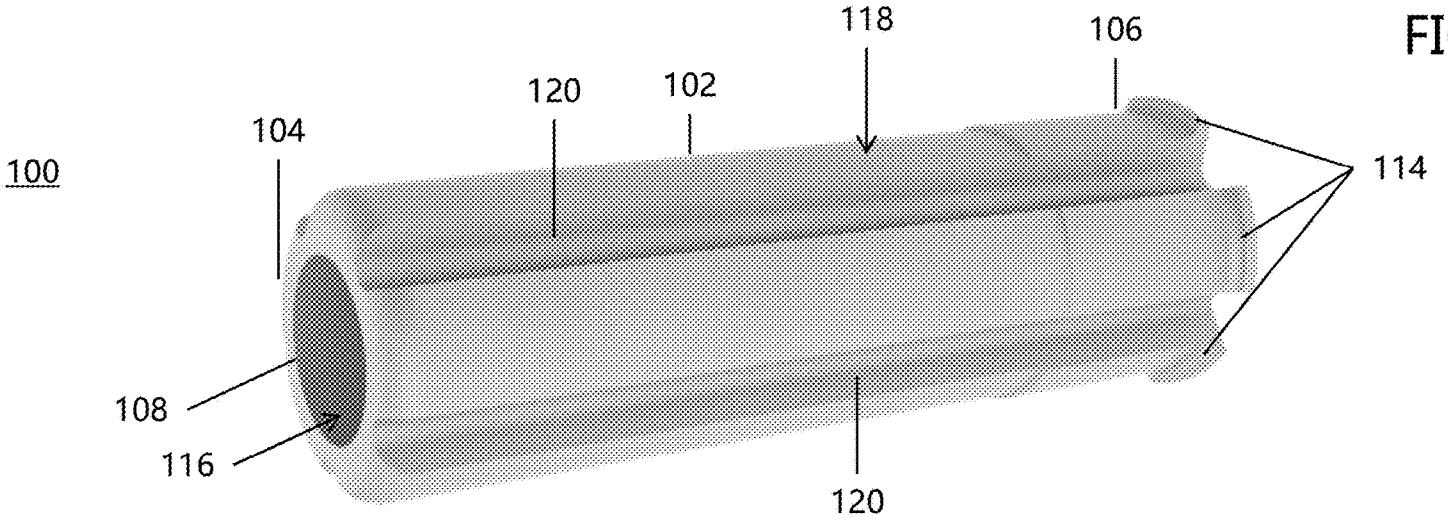
FIGS. 1A-1F and 3A-3C are illustrations and pictures according to a non-limiting embodiment of the present disclosure, where

A more complete understanding of the articles/devices, processes and components disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, all the intermediate values and all intermediate ranges).

The terms "about" and "approximately" can be used to include any numerical value that can vary without changing the basic function of that value. When used with a range, "about" and "approximately" also disclose the range defined by the absolute values of the two endpoints, e.g. "about 2 to about 4" also discloses the range "from 2 to 4." Generally, the terms "about" and "approximately" may refer to plus or minus 10% of the indicated number.

Percentages of elements should be assumed to be percent by weight of the stated element, unless expressly stated otherwise.

Figure 1B:
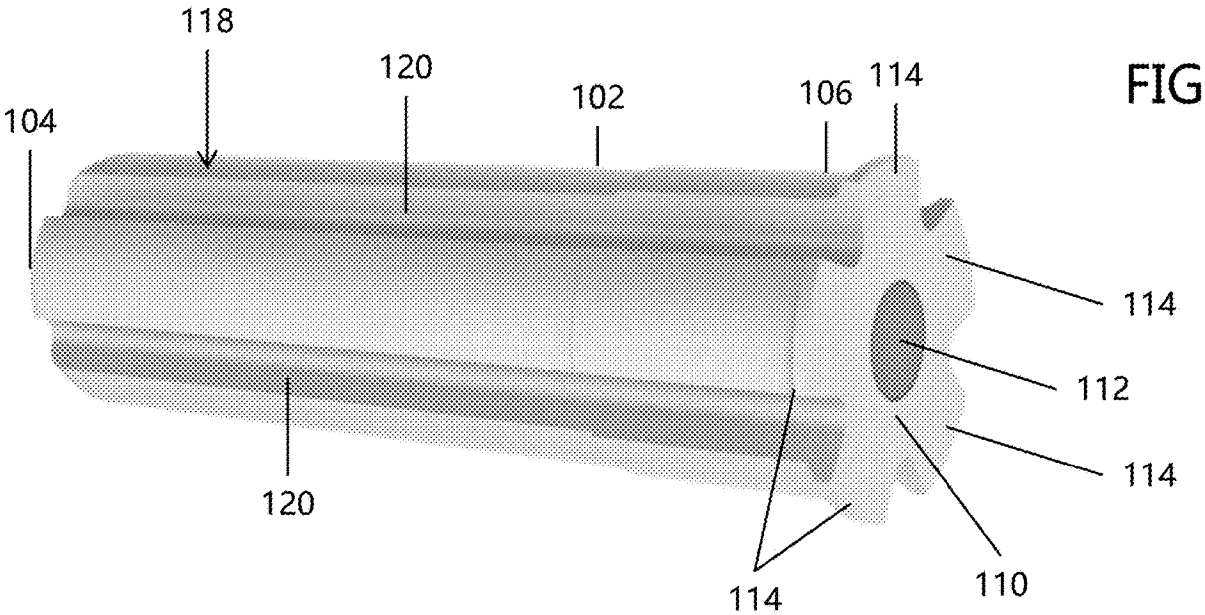
Figure 1D:
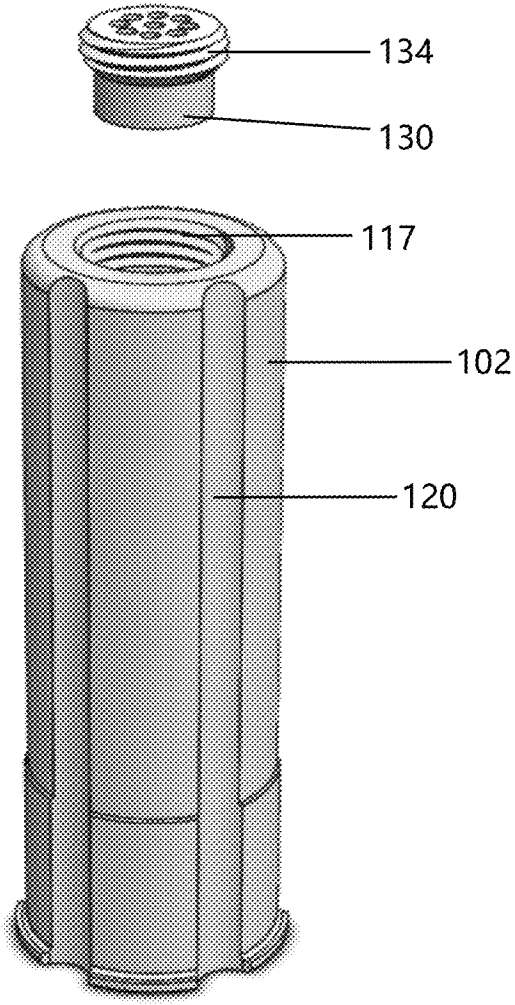
Figure 1C:
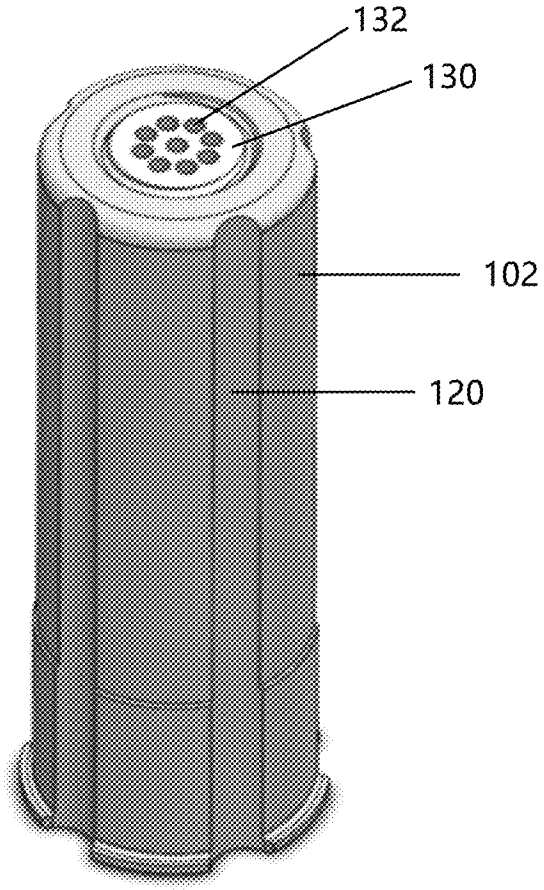

Referring now to FIGS. 1A-1B and 3A-3C, there is illustrated a first non-limiting embodiment of a snap cap device having corrosion protection. As illustrated in FIGS. 1A-1B, the primary components of the snap cap device 100 generally include, but are not limited to, a body portion 102, a hollow interior region or cavity 108, and one or more surface features 120 disposed on an external surface of the body portion. The body portion 102 is configured to be inserted within the barrel, magazine, chamber, etc., of a firearm and to provide protection against corrosion, tarnish, and rust. In this regard, the exemplary snap cap body 102 is made from or otherwise includes a material which releases corrosion protection molecules. For example, the snap cap body 102 can be formed of a polymer material and include a protective material such that corrosion protection molecules from the protective material are released from the snap cap body 102. Additional features of the exemplary snap cap device 100 will now be described.

As briefly mentioned above, the snap cap device 100 generally includes a snap cap body 102 that extends between a first end 104 and a second end 106. The first end 104 is generally configured to be inserted within the barrel, magazine, chamber, etc. of a firearm. The second end 106 is generally configured to be disposed adjacent a firing pin of the associated firearm when the first end 104 has been inserted in the barrel, magazine, or chamber of a firearm. More generally, the snap cap body 102 is configured to rest in the portion of a firearm where ammunition, such as, for example, a bullet or a shotgun shell, is disposed immediately before firing the firearm. However, it can be appreciated that the snap cap body 102 can be inserted in an ammunition clip or magazine to provide corrosion protection to ammunition, a magazine, etc.

The snap cap body 102 is illustrated as being generally cylindrical in shape. However, the particular shape of the body 102 is non-limiting and any desired shape can be used provided the snap cap is able to be fit within an associated firearm as discussed above. For example, the snap cap body could have a cuboid or conical shape. A hollow interior region or cavity 108 is accessible adjacent the first end 104 of the snap cap body 102 via an opening in the first end 104. The snap cap body includes an end wall 110 that is disposed at the second end 106. When the snap cap body 102 is inserted into an associated firearm, the end wall 110 generally faces the firing pin of the associated firearm. In this regard, the end wall 110 can optionally include a strike wall 112 configured to receive the impact force of the firing pin during a dry-firing event. The strike wall 112 can also be referred to as a false primer, as is known in the art. In some embodiments, the strike wall 112 can be spring-buffered or made from a rubber or soft polymer material to help absorb the impact force from the firing pin during dry-firing. However, such a configuration is non-limiting. The strike wall 112 is generally located in the middle of the end wall 110 and generally has a circular shape; however, this is not required. Generally, the strike wall 112 is formed of a different material from the snap cap body 102 and is configured to be inserted into and/or connected to the snap cap body 102 via a strike wall opening located in the end wall 110.

The second end 106 of the snap cap body 102 can optionally include one or more flanges or stop wall 114 that is disposed fully or partially around the exterior perimeter of the snap cap body. As illustrated in FIGS. 1A and 1B, a plurality of flanges 114 are radially disposed around a circumference of the cylindrical snap cap body 102 and located at the second end 106. The flanges 114 generally protrude outward from/parallel to the end wall 110 and outward from/perpendicular to the cylindrical walls of the snap cap body 102. In other words, the flanges 114 form an approximate 90° angle with the snap cap body 102. In this regard, the flanges 114 are generally configured to rest against at least a portion of the barrel, magazine, or chamber of an associated firearm in which the snap cap body 102 is disposed, thereby maintaining the end wall 110 in adjacent relation to the firing pin of the associated firearm and preventing the snap cap body from sliding down into an unwanted area of the barrel, magazine, or chamber. However, the means to maintain the end wall 110 in adjacent relation to the firing pin of the associated firearm and prevent the snap cap body from sliding down into an unwanted area of the barrel, magazine, or chamber are non-limiting.

Figure 1F:
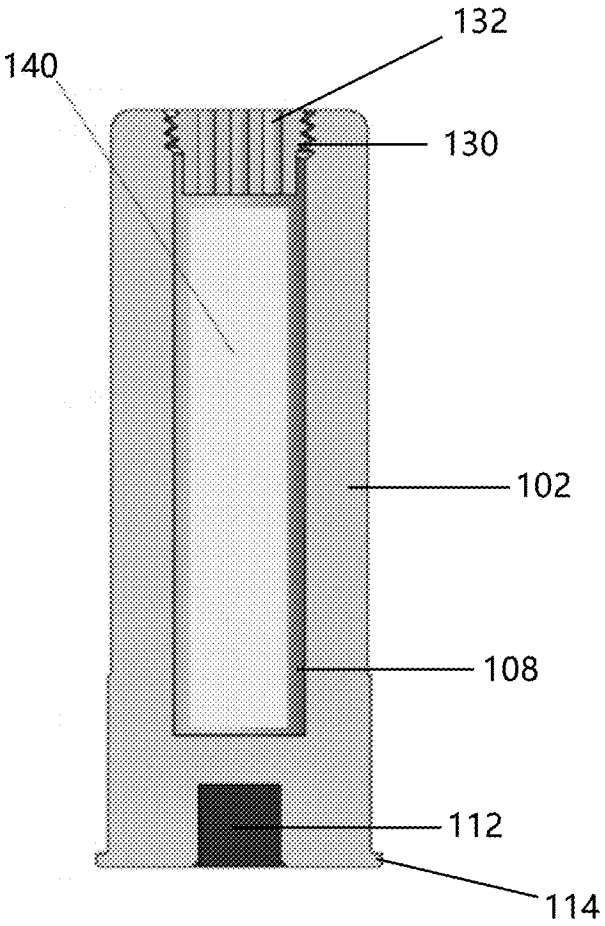
Figure 1E:
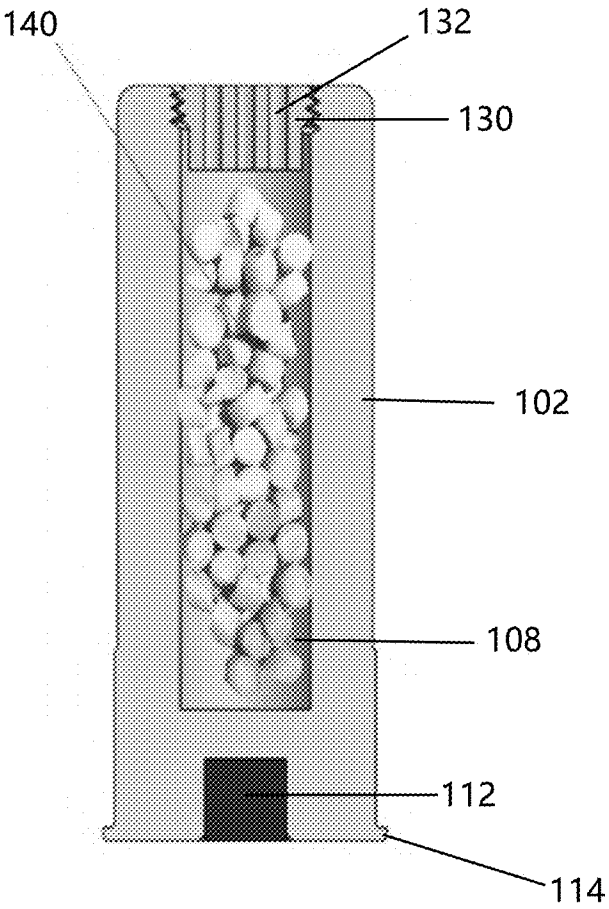

As mentioned above, the opening in the first end 104 of the snap cap body 102 provides access to a hollow interior region 108. The hollow interior region 108 is generally defined by an interior surface wall 116, and an opposing wall 118 defines an exterior surface of the snap cap body 102. The cross-sectional shape of the hollow interior region 108 is illustrated as being circular; however, other shapes can be used. The cross-sectional area and cross-sectional shape of the hollow interior region 108 is generally uniform along a majority of the longitudinal length of the hollow interior region 108; however, this is not require. As illustrated in FIGS. 1E-1F, the hollow interior region 108 does not extend the full longitudinal length of the snap cap body 102; however, this is not required. Generally, the hollow interior region 108 extend about 10-98% of the longitudinal length of the snap cap body 102 (and all values and ranges therebetween), and typically the hollow interior region 108 extend about 60-98% of the longitudinal length of the snap cap body 102.

As illustrated in FIGS. 1A-1D, the exterior surface wall 118 can optionally include one or more surface features 120 in/on the exterior surface wall. The one or more surface features 120 of the exterior surface wall 118 include one or more grooves formed in the snap cap body 102. The one or more grooves 120 can extend a full or partial length of the snap cap body 102. In some particular embodiments, the one or more grooves 120 extend the entire length of the snap cap body 102, from the first end 104 adjacent the hollow interior region 116 to the second end 106 adjacent the end wall 110. However, such a configuration is non-limiting. Moreover, the one or more grooves 120 are illustrated in FIGS. 1A-1D as being substantially straight; however a variety of shapes can be used (e.g. spiral, serpentine, curved, etc.). Also, the one or more grooves 120 are illustrated in FIGS. 1A-1D as having a generally C-shaped or U-shaped cross-sectional profile; however, it can be appreciated that the one or more grooves 120 can have other cross-sectional shapes. As can be appreciated, the one or more grooves 120 can have any desired shape without departing from the scope of the present disclosure, such as a curved or helical shape. In addition, while FIGS. 1A-1D illustrate the snap cap body 102 as having five grooves formed in the exterior surface wall 118, this number is only exemplary and any number of surface features can be included without departing from the scope of the present disclosure. Generally, the one or more surface features 120 of the exterior surface wall 118 constitute less than 80% of the exterior surface area of the snap cap body 102, generally less than 70% of the exterior surface area of the snap cap body 102, and typically less than 60% of the exterior surface area of the snap cap body 102.

The one or more surface features 120 can be used to enable the corrosion protection molecules that are released from the protective material to flow about the exterior surface wall 118 of the snap cap body 102 between the first and second ends 104, 106 of the snap cap body 102. Such an arrangement is particularly advantageous when the snap cap body 102 is at least partially formed of a protective material. In such a configuration, powder, pellets, plugs, etc. 140 of material that includes the protective material are placed in the hollow interior region 108 and a plug 130 is then inserted into the opening on the first end 104 to retain the powder, pellets, plugs, etc. of material that includes the protective material in the hollow interior region 108 (as illustrated in FIGS. 1C-1F). FIG. 1E illustrates powder or pellets 140 of protective material. FIG. IF illustrates a plug 140 of protective material. The plug 130 can optionally be formed of a porous material and/or include one or more holes 132 that allows the corrosion protection molecules that are released from the protective material to flow through the plug 130 and then disperse about the exterior surface wall 118 of the snap cap body 102 and beyond the second end 106 of the snap cap body 102 via the one or more surface features 120. The plug 130 can be connected to the first end 104 by use of a thread 134 on plug 130 and a corresponding thread 117 in the hollow interior region 108. In such an arrangement, the plug 130 can be removed so that the protective material can be replaced and/or new protective material can be added to the hollow interior region 108. As can be appreciated, other or additional arrangement can be used to enable the corrosion protection molecules that are released from the protective material to flow out of the hollow interior region 108 (e.g., one or more holes in the snap cap body 102 that are smaller in size than the powder, pellets, plugs, etc. of material that includes the protective material, one or more holes in the first and/or second ends 104, 106 of the snap cap body 102 that are smaller in size than the powder, pellets, plugs, etc. of material that includes the protective material, one or more holes in the strike wall 112 that are smaller in size than the powder, pellets, plugs, etc. of material that includes the protective material, a porous strike wall 112 that allows the corrosion protection molecules that are released from the protective material to flow through the strike wall 112, etc.).

When the snap cap body 102 is formed of a material that includes the protective material, the use of the one or more surface features 120 can be absent from the snap cap body 102. Also, when the snap cap body 102 is formed of a material that includes the protective material, the snap cap body 102 can be absent the hollow interior region 108.

Figure 3A:
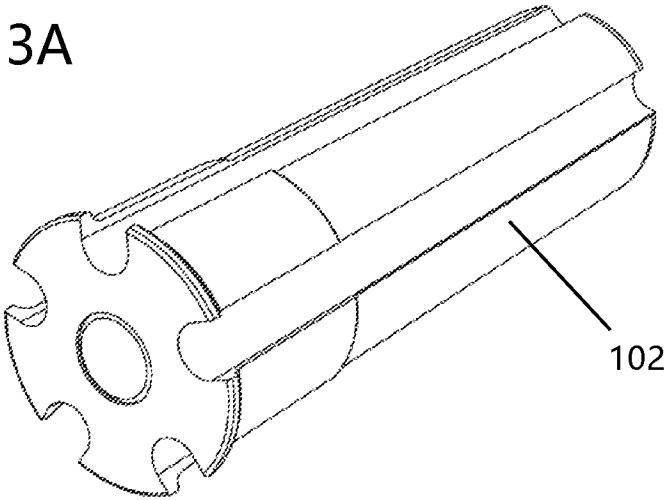
Figure 3B:
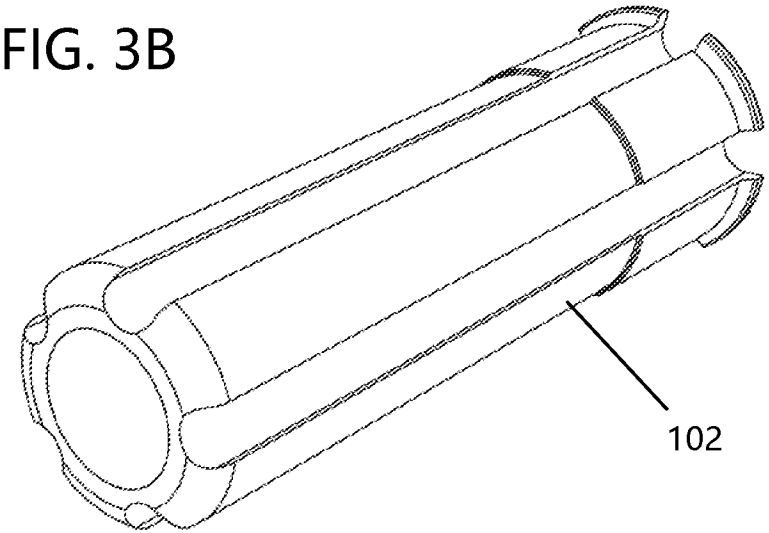

Referring now to FIGS. 3A-3B, the shape of the snap cap device is substantially the same shape as snap cap device 100 as illustrated in FIGS. 1A-1B. The difference in the two snap cap devices is that the snap cap device illustrated in FIGS. 3A-3B has a snap cap body 102 that is fully formed of a metal material that is absent a protective material. In such snap cap device, powder, pellets, plugs, etc. of material that includes the protective material (not shown) are placed in the hollow interior region 108 and a plug is then inserted into the opening on the first end 104 to retain the powder, pellets, plugs, etc. of material that includes the protective material in the hollow interior region 108 as discussed above with regard to FIGS. 1C-1E.

Figure 2A:
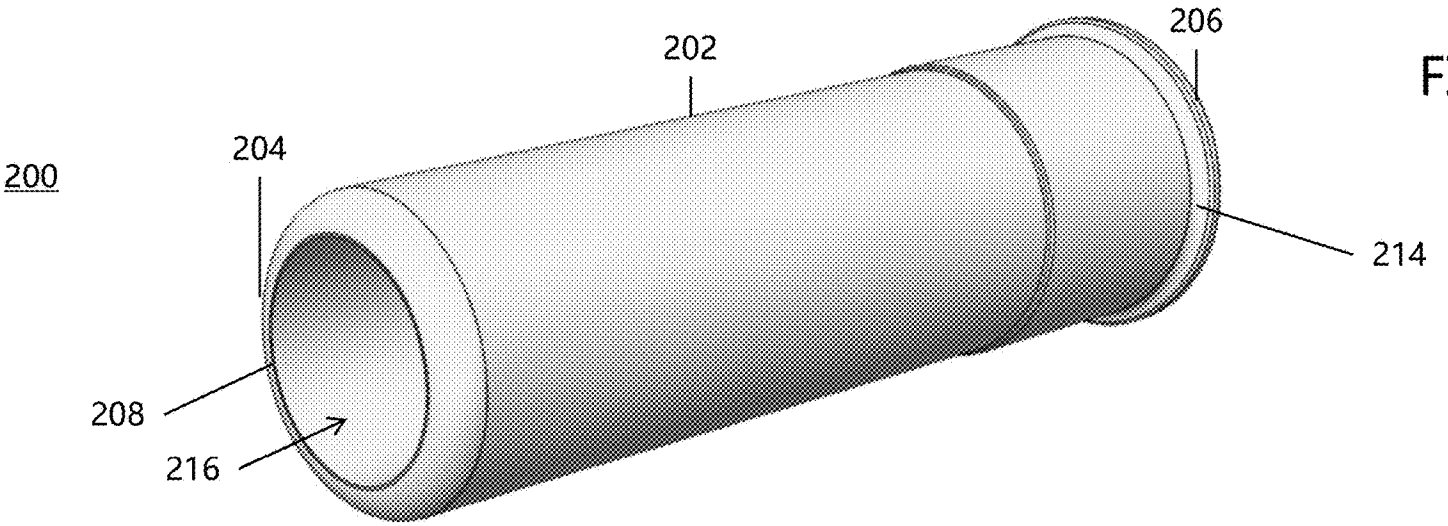
FIGS. 2A-2B are illustrations according to a non-limiting embodiment of the present disclosure, where
Figure 2B:
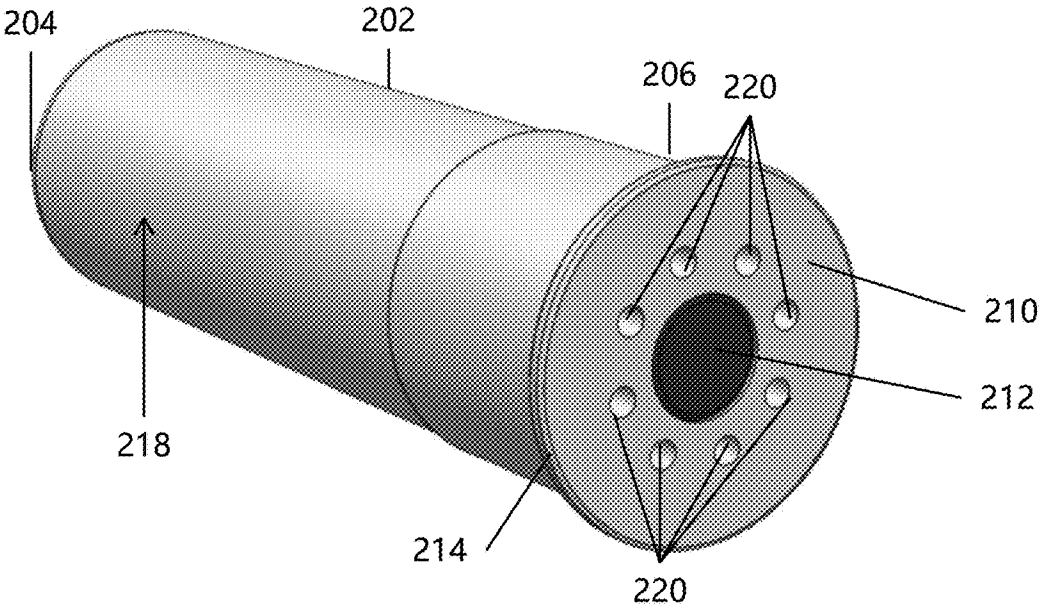

Referring now to FIGS. 2A-2B, there is illustrated a second non-limiting embodiment of a snap cap device 200 having corrosion protection. The primary components of the snap cap device 200 generally include, but are not limited to, a snap cap body 202, a hollow interior region or cavity 208, and one or more vent holes 220 disposed on end wall 210 of the snap cap body 202. The snap cap body 202 is configured to be inserted within the barrel, magazine, chamber, etc. of a firearm and to provide protection against corrosion, tarnish, and rust. In this regard, the exemplary snap cap body 202 is made from or otherwise includes a material which releases corrosion protection molecules. Additional features of the exemplary snap cap device 200 will now be described.

As briefly mentioned above, the snap cap device 200 generally includes a snap cap body 202 that extends between a first end 204 and a second end 206. The first end 204 is generally configured to be inserted within the barrel, magazine, chamber, etc. of an associated firearm. The second end 206 is generally configured to be disposed adjacent a firing pin of the associated firearm when the first end 204 has been inserted in the barrel, magazine, or chamber. More generally, the snap cap body 202 is configured to rest in the portion of a firearm where ammunition, such as, for example, a bullet or a shotgun shell, is disposed immediately before firing the firearm.

The snap cap body 202 is illustrated as being generally cylindrical in shape. However, the particular shape of the body 202 is non-limiting, and any desired shape can be used provided the snap cap is able to be fit within an associated firearm as discussed above. For example, the snap cap body could have a cuboid or conical shape. A hollow interior region 208 is accessible via an opening in the first end 204 of the snap cap body 202, and the end wall 210 is disposed at the second end 106. When the snap cap body 202 is inserted into an associated firearm, the end wall 210 generally faces the firing pin of the associated firearm. In this regard, the end wall 210 can optionally include a strike wall 212 configured to receive the impact force of the firing pin during a dry-firing event. The strike wall 212 can also be referred to as a false primer, as is known in the art. In some embodiments, the strike wall 212 can be spring-buffered or made from a rubber or soft polymer material to help absorb the impact force from the firing pin during dry-firing. However, such a configuration is non-limiting. The strike wall 212 is generally located in the middle of the end wall 210 and generally has a circular shape; however, this is not required. Generally, the strike wall 212 is formed of a different material that then of snap cap body 202 and is configured to be inserted into and/or connected to the snap cap body 202 via a strike wall opening located in the end wall 210.

The second end 206 of the snap cap body 202 also includes a flange or stop wall 214 disposed around the exterior perimeter of the snap cap body. More particularly, the stop wall 214 is radially disposed around the entire circumference of the cylindrical snap cap body 202 adjacent the second end 206 thereof; however, this is not required. The stop wall 214 generally protrudes outward from/parallel to the end wall 210 and outward from/perpendicular to the cylindrical wall of the snap cap body 202. In other words, the stop wall 214 forms an approximate 90 degree angle with the snap cap body 202. In this regard, the stop wall 214 is generally configured to rest against at least a portion of the barrel, magazine, or chamber of an associated firearm in which the snap cap body 202 is disposed, thereby maintaining the end wall 210 in adjacent relation to the firing pin of the associated firearm and preventing the snap cap body from sliding down into an unwanted area of the barrel, magazine, or chamber. However, the means to maintain the end wall 110 in adjacent relation to the firing pin of the associated firearm and prevent the snap cap body from sliding down into an unwanted area of the barrel, magazine, or chamber are non-limiting.

As mentioned above, an opening in the first end 204 of the snap cap body 206 provides access to a hollow interior region 208. The hollow interior region 208 is generally defined by an interior surface wall 216, and an opposing wall 218 defines an exterior surface of the snap cap body 202. The distance between the interior surface wall 216 and opposing exterior surface wall 218 defines a thickness of the snap cap body 202. In some particular non-limiting embodiments, the exterior surface wall 218 is configured to be substantially smooth. In other words, the exterior surface wall 218 is substantially planar along a length of the snap cap body 202 between the first and second ends 204, 206 thereof. As a result, the end wall 210 and stop wall 214 are substantially circular in shape. However, such a configuration is non-limiting. For example, the exterior surface wall 218 can optionally include one or more surface features as described above with respect to the snap cap device illustrated in FIGS. 1A-1D.

As discussed briefly above, the second end 206 of the snap cap body 202 includes one or more vent holes 220. The one or more vent holes 220 are illustrated in FIG. 2B as being disposed on the end wall 210; however, such a configuration is non-limiting. That is, the one or more vent holes could be located in any desired location on the snap cap body 202 without departing from the scope of the present disclosure. For example, the one or more vent holes could be disposed on the exterior surface wall 218 adjacent the first or second ends 204, 206. In any event, the one or more vent holes 220 should be configured to fluidly connect the hollow interior 208 to the external atmosphere of the snap cap body 202. Moreover, while the one or more vent holes 220 are illustrated in FIG. 2B as being circular in shape, the particular shape of the vent holes is non-limiting. For example, the vent holes could be rectangular or triangular in shape without departing from the scope of the present disclosure. Similarly, even though the one or more vent holes 220 are illustrated in FIG. 2B as being disposed in concentric relation to the strike wall 212, the particular arrangement of the one or more vent holes is non-limiting. In addition, while the snap cap body 202 of FIGS. 2A-2B is illustrated as having eight vent holes disposed on the end wall 210, this number is only exemplary and any number of vent holes can be included without departing from the scope of the present disclosure.

The one or more vent holes 220 can be used to enable the corrosion protection molecules that are released from the protective material to flow between the first and second ends 204, 206 of the snap cap body 202. Such an arrangement is particularly advantageous when the snap cap body 202 is not at least partially formed of a protective material. In such a configuration, powder, pellets, plugs, etc. of material that includes the protective material (not shown) are placed in the hollow interior region 208 and a plug (not shown) is then inserted into the opening on the first end 204 to retain the powder, pellets, plugs, etc. of material that includes the protective material in the hollow interior region 208. The plug can optionally be formed of a porous material that allows the corrosion protection molecules that are released from the protective material to flow through the plug, thereby allowing the corrosion protection molecules to escape the hollow interior region 208 at the first end 204 of the snap cap body 202. The one or more vent holes 220 can be used to allow the corrosion protection molecules that are released from the protective material to flow through one or more vent holes 220, thereby allowing the corrosion protection molecules to escape the hollow interior region 208 at the second end 206 of the snap cap body 202. Generally, the one or more vent holes 220 are sized to prevent powder, pellets, plugs, etc. of material that includes the protective material from passing through the one or more vent holes 220. As can be appreciated, a plug arrangement as described above with regard to FIGS. 1C-1F can be used. As can be appreciated, other or additional arrangements can be used to enable the corrosion protection molecules that are released from the protective material to flow out of the hollow interior region 208 (e.g., one or more holes in the snap cap body 202 that are smaller in size than the powder, pellets, plugs, etc. of material that includes the protective material, one or more holes in the first end 204 of the snap cap body 202 that are smaller in size than the powder, pellets, plugs, etc. of material that includes the protective material, one or more holes in the strike wall 212 that are smaller in size than the powder, pellets, plugs, etc. of material that includes the protective material, a porous strike wall 212 that allows the corrosion protection molecules that are released from the protective material to flow through the strike wall 212, etc.).

When the snap cap body 202 is formed of a material that includes the protective material, the one or more vent holes 220 can be absent from the snap cap body 202. Also, when the snap cap body 202 is formed of a material that includes the protective material, the snap cap body 202 can be absent the hollow interior region 208.

Figure 4:
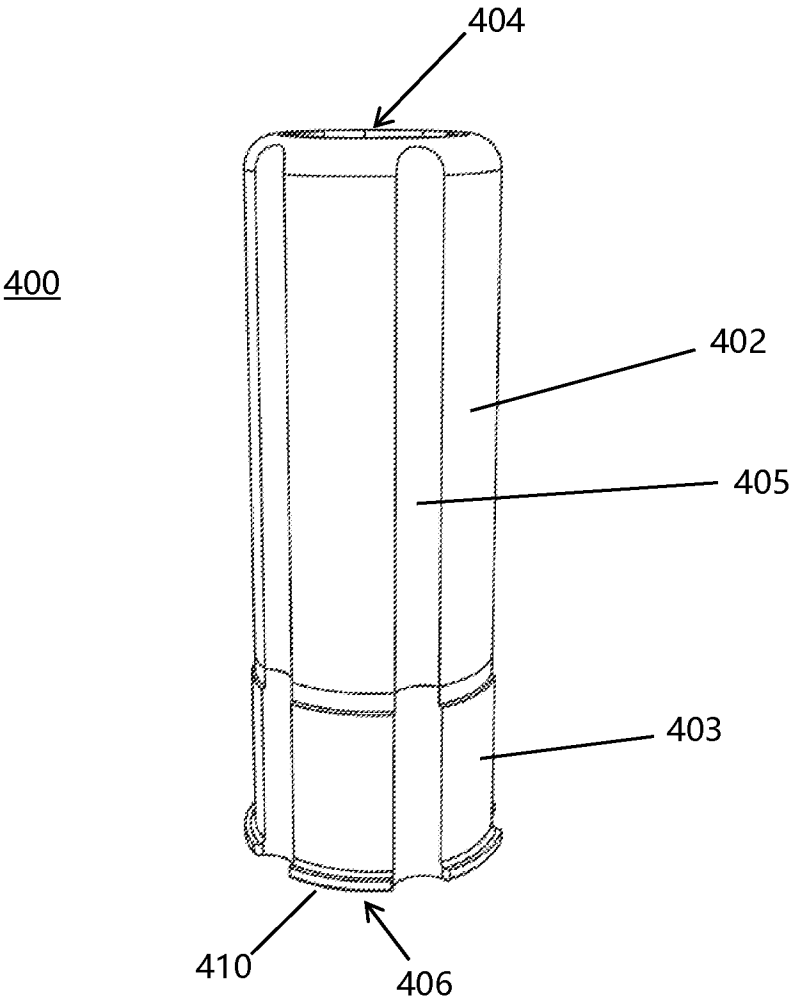
FIGS. 4-7 are illustrations according to a non-limiting embodiment of the present disclosure and illustrates and shows a snap cap device configured to be inserted in an associated firearm.
Figure 5:
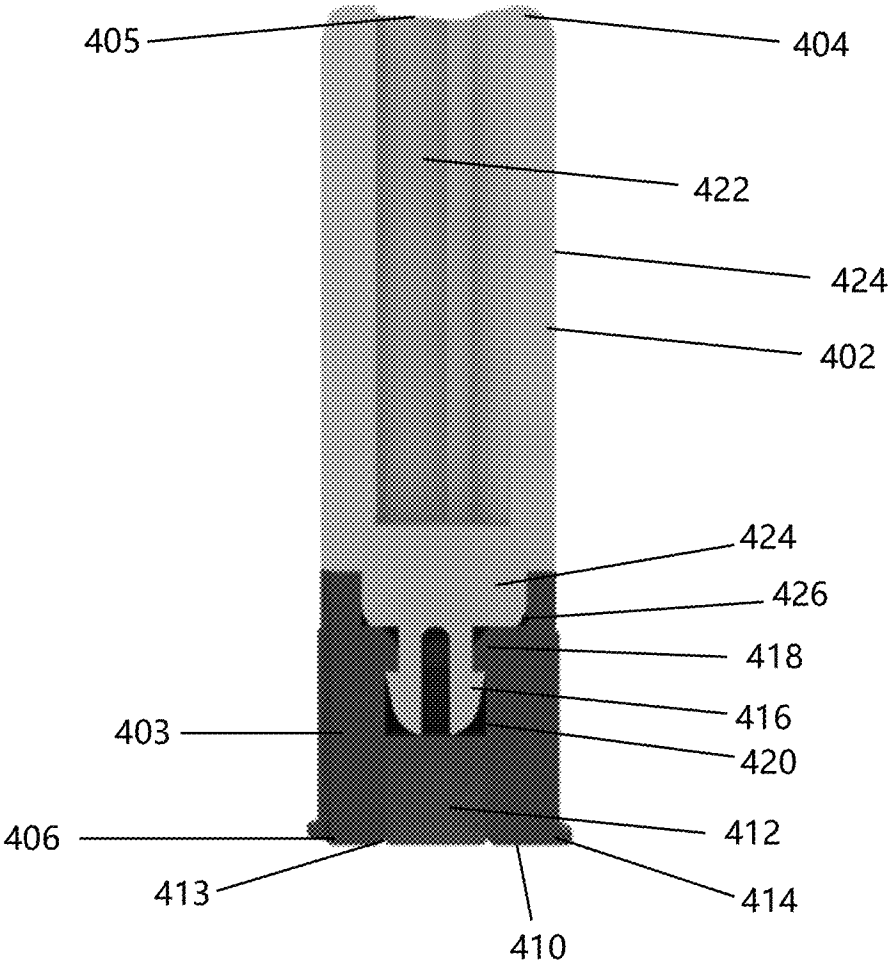

Referring now to FIGS. 4-5, there is illustrated a third non-limiting embodiment of a snap cap device 400 having corrosion protection. Many of the features and structures of the snap cap device 400 are the same or similar to snap cap device 100 illustrated in FIGS. 1A-1F and 3A-3B, thus will not be repeated herein.

Snap cap device 400 includes a snap cap body that is formed of an upper cap body 402 and a snap cap base 403. The upper cap body 402 extends from the snap cap base 403 and includes a first end 404 generally configured to be inserted within the barrel, magazine, chamber, etc. of an associated firearm. The snap cap base 403 includes a second end 406 and is generally configured to be disposed adjacent a firing pin of the associated firearm when the first end 404 of snap cap body 402 has been inserted in the barrel, magazine, or chamber. More generally, the snap cap 400 is configured to rest in the portion of a firearm where ammunition such as, for example, a bullet or a shotgun shell, is disposed immediately before firing the firearm.

The snap cap base 403 includes an end wall 410 disposed at the second end 406. When the snap cap 400 is inserted into an associated firearm, the end wall 410 generally faces the firing pin of the associated firearm. In this regard, the end wall 410 can optionally include an aperture 413 configured to receive a strike wall 412 that is configured to receive the impact force of the firing pin during a dry-firing event. The strike wall 412 is generally located in the middle of the end wall 410 and generally has a circular shape; however, this is not required. Generally, the strike wall 412 is formed of a different material and is a separate component from the upper cap body 402 and is configured to be inserted into and/or connected to the upper cap body 402 via a strike wall opening located in the end wall 410 as illustrated in FIG. 5.

The second end 406 of the snap cap base 403 also includes one or more flanges 414 disposed at least partially around the exterior perimeter of the snap cap base 403. More particularly, the one or more flanges 414 are radially disposed around a circumference of the cylindrical snap cap base 403 adjacent the second end 406 thereof. The one or more flanges 414 generally protrude outward from/parallel to the end wall 410 and outward from/perpendicular to the cylindrical walls of the upper cap base 402. In this regard, the one or more flanges 414 are generally configured to rest against at least a portion of the barrel, magazine, or chamber of an associated firearm in which the snap cap 400 is disposed, thereby maintaining the end wall 410 in adjacent relation to the firing pin of the associated firearm and preventing the snap cap from sliding down into an unwanted area of the barrel, magazine, or chamber.

The snap cap base 403 may be composed of a metal material. In some embodiments, the metal material is stainless steel. In other embodiments, the metal material is metal that is softer than the metal of an associated firearm such as, for example and without limitation, copper and copper-alloy. In this way, the metal snap cap base 403 is less likely to damage the metal barrel of a firearm. In one non-limiting embodiment, the metal snap cap base 403 is formed of a material that does not include a protective material.

The snap cap base 403 is configured to receive and connect to upper cap body 402. In some embodiments, the upper cap body 402 is permanently attached to the snap cap base 403. In other embodiments the upper cap body 402 is removably attached to the snap cap base 403 and can be replaced.

In some embodiments, the upper cap body 402 is formed of different material from the snap cap base 403. In one non-limiting example, the upper cap body 402 is composed of a material (e.g., plastic material, silicon, composite material, metal, resin, urethane, wood, etc.) that includes the protective material and the snap cap base 403 is formed of a material that is absent the protective material. In one non-limiting arrangement, the upper cap body 402 can be over-molded on the snap cap base 403 to permanently secure the upper cap body 402 to the snap cap base 403. In some embodiments, the upper cap body 402 may be separately formed and adhered to the snap cap base 403 by, for example and without limitation, an adhesive or mechanical connection arrangement.

When the upper cap body 402 is removably attached to the snap cap base 403 and can be replaced, the upper cap body 402, after losing some or all of its corrosion protection properties, can be replaced with a new upper cap body 402 without the need for a new snap cap base 403. In some embodiments, the upper cap body 402 may be formed with a set of threads that are configured to engage a set of receiving threads in the snap cap base 403 to facilitate in the removal and replacement of the upper cap body 402 to snap cap base 403, although it is to be appreciated that other removable attachments are also contemplated.

Referring now to FIG. 5, there is illustrated a cross-sectional view taken along the central longitudinal axis of the snap cap device 400. As illustrated in FIG. 5, a non-limiting permanent connection arrangement is shown between the upper cap body 402 and snap cap base 403. The bottom portion of the upper cap body 402 includes a reduced cross-sectional area portion 424 that is seated in an upper cavity 426 of the snap cap base 403 which is used to limit the distance that the upper cap body 402 can be received in upper cap body 402. Positioned below the reduced cross-sectional area portion 424 is a clip arrangement 416 which is configured to engage a ridge portion 418 on the snap cap base 403 that is used to permanently secure the upper cap body 402 to snap cap base 403.

As illustrate in FIG. 5, hollow interior 422 only extends partially through the snap cap body 402.

The one or more surface features 405 can be used to enable the corrosion protection molecules that are released from the protective material to flow about the exterior surface wall 424 of the snap cap device 400 between the ends 404, 406 of the snap cap device 400. Such an arrangement is particularly advantageous when the upper cap body 402 and/or the snap cap base 403 is at least partially formed of a protective material. In one non-limiting configuration, powder, pellets, plugs, etc. of material that includes the protective material (not shown) can be placed in the hollow interior region 422 and a plug (not shown) is then inserted into the opening on the first end 404 to retain the powder, pellets, plugs, etc. of material that includes the protective material in the hollow interior region 422. The plug can optionally be formed of a porous material that allows the corrosion protection molecules that are released from the protective material to flow through the plug and then disperse about the exterior surface wall 424 of the snap cap device 400 via the one or more surface features 405. As can be appreciated, other or additional arrangement can be used to enable the corrosion protection molecules that are released from the protective material to flow out of the hollow interior region 422 (e.g., one or more holes in the upper cap body 402 that are smaller in size than the powder, pellets, plugs, etc. of material that includes the protective material, one or more holes in the first end 404 of the upper cap body 402 that are smaller in size than the powder, pellets, plugs, etc. of material that includes the protective material, etc.). When the upper cap body 402 is formed of a material that includes the protective material, the use of the one or more surface features 405 can be absent from the upper cap body 402 and/or the inclusion of powder, pellets, plugs, etc. of material that includes the protective material in the hollow interior region 422 is not required. As can be appreciated, the plug and protective material arrangement as illustrated in FIGS. 1E-1F can be used in the snap cap device 400.

Figure 7:
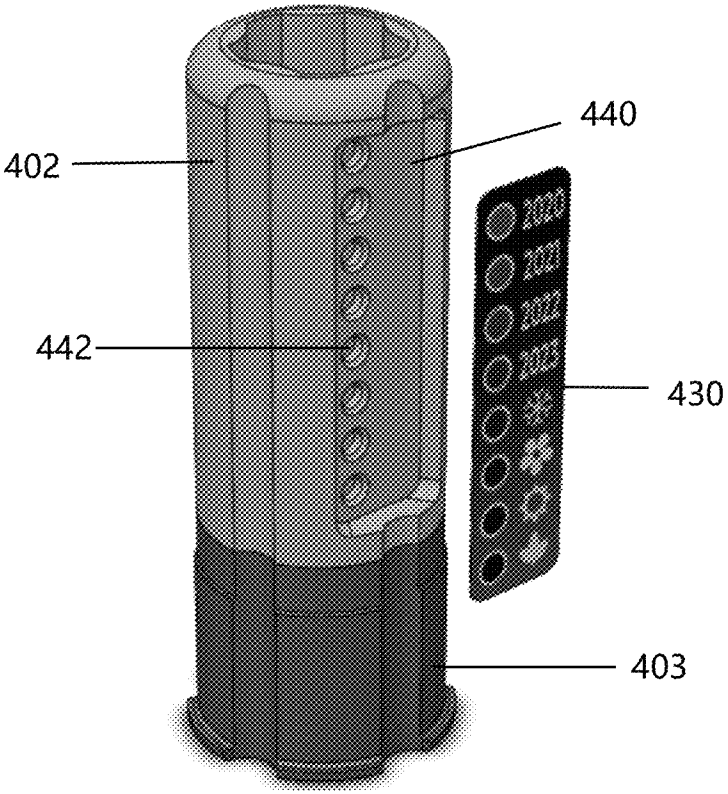
Figure 6:
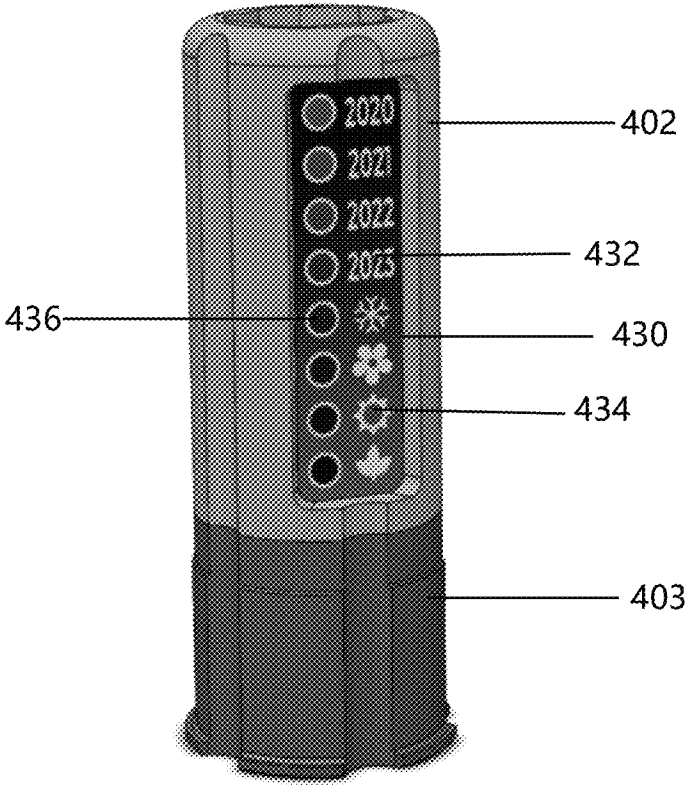

Referring now to FIGS. 6-7, there is illustrated a snap cap device having a configuration similar to snap cap device 400 as described above; however, it can be appreciated, that the snap cap device can have other configures such as, but not limited to, the snap cap device illustrated in FIGS. 1A-1F, 2A-2B and 3A-3B. The snap cap device 400 is illustrated as upper cap body 402 that includes a recessed portion 440 that includes and one or more recess cavities 442. The size and shape of the recessed portion is non-limiting. As illustrated in FIG. 7, the shape of the recessed portion is generally rectangular; however, this is not required. Generally, the recessed portion does not penetrate the hollow interior region 422; however, this is not required. The one or more recess cavities 442 can be oriented in any configuration in the recessed portion 440. As illustrated in FIG. 7, there are a plurality of recess cavities 442 (e.g., 2-10, 8, etc.) in the recessed portion 440. The plurality of recess cavities 442 are aligned along the left side of the recessed portion 440. The shape of the plurality of recess cavities 442 are generally circular; however, other shapes can be used. The plurality of recess cavities 442 generally occupy less than 50% of the surface area of the recessed portion 440. The plurality of recess cavities 442 are illustrated as having the same shape, size and configuration; however, this is not required. The plurality of recess cavities 442 are illustrated as being spaced from one another and spaced from the sides of the recessed portion 440.

A time indicator panel 430 is configured to be inserted in the recessed portion 440. Generally, the shape of the indicator panel 430 is the same or similar to the shape of the recessed portion 440. The time indicator is generally formed of a metal foil, paper, paper board, or a plastic film or sheet. As illustrated in FIG. 6, the thickness of the time indicator panel 430 is less than the depth of the recessed portion 440; however, this is not required. Time information (432, 434, 436) is located on the front face of time indicator panel 430. For example, time information 432 is in the form of numerical years (e.g., 2020, 2021, 2022, 2023), time information 434 is in the form of pictures that represent seasons (e.g., snow flake—winter, flower—spring, sun—summer, leaf—fall), and time information 436 is in the form of selection circles that are positioned next to time information 432 and 434. The position of the selection circles is oriented over the recess cavities 442 such that a user can use a pencil, pin or other object to puncture one or more of the selection circles. The time indicator panel 430 is used by a user to indicate when the snap cap device is first used. For example, if the snap cap device was first inserted in a firearm in the fall of 2021, then the selection circles next to 2021 and the leaf would be punctured or otherwise marked by a user to indicate such time period. As such, time panel indicator 430 can be used by a user to determine when to replace a snap cap device or the protective material in the snap cap device.

Figure 3C:
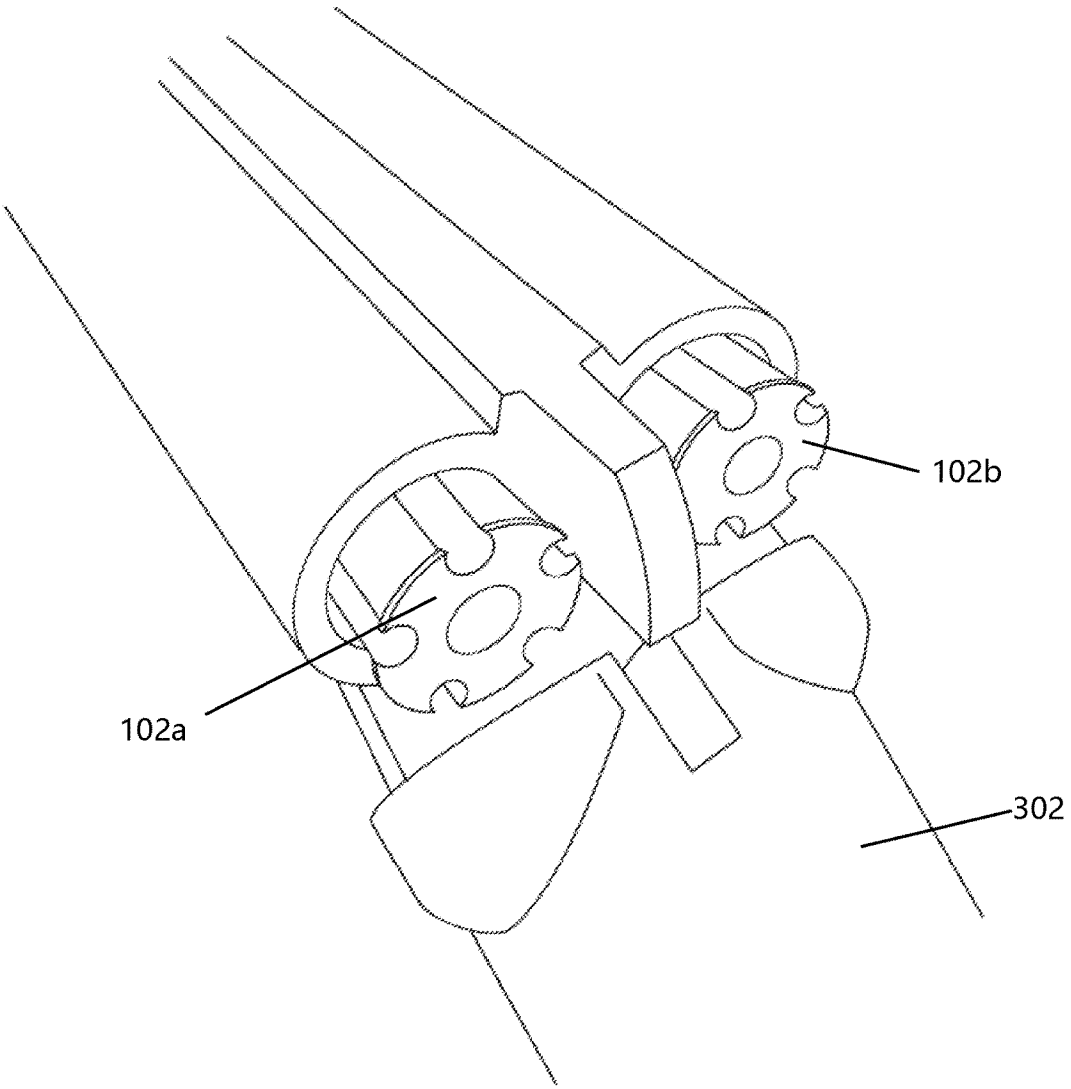

As discussed above, the exemplary rust and corrosion preventative snap cap devices described herein and shown in FIGS. 1A-1F, 2A-2B, 3A-3B, and 4-7 are made from or otherwise include a protective material which releases corrosion protection molecules that protect against rust, corrosion, and tarnish. These exemplary devices include the snap cap bodies 102, 202, and 402 as illustrated and shown in FIGS. 1A-1F, 2A-2B, 3A-3B, and 4-7, and as discussed above. The presently disclosed snap cap bodies 102, 202, 402 are configured to be inserted into the barrel, magazine, chamber, etc., of an associated firearm, such as firearm 302 as illustrated in FIG. 3D, and these firearm components are typically made from metal. As illustrated in FIG. 3C, two snap cap bodies (102*a*, 102*b*) are partially positioned in a gun chamber.

Moreover, the associated firearms into which snap cap bodies 102, 202, 402 are configured to be inserted can generally be exposed to the environment for substantial periods of time. As such, firearms and their associated components are particularly susceptible to rust, corrosion, and tarnish. However, by including the exemplary protective snap cap devices 100, 200 and 400 described herein, rust, corrosion, and tarnish can be prevented or otherwise delayed over the life of the firearm.

In order to provide rust, corrosion, and tarnish protection, the snap cap devices 100, 200 and 400 are made with or otherwise includes a substance which inhibits volatile or vapor corrosion. The inhibiting behavior of the substance is enabled by a plurality of mechanisms. In general, the plurality of mechanisms enabling the inhibiting behavior of the substance all include the release of vapor into the air and the deposition of protective molecules on all exposed surfaces of the firearm. In one exemplary inhibiting mechanism, the corrosion protection molecules form a protective barrier against external dirt and abrasion. The molecular barrier layer inhibits electro-chemical reactions on metal surfaces by blocking the diffusion of corrosive acid gas pollutants from the environment, thereby preventing contact between these corrosive gases and the metal surfaces. In another exemplary inhibiting mechanism, the deposited molecules form a molecular layer of corrosion inhibitors that passivate the electron flow between the anodic and cathodic areas on metal surfaces and interrupt the electro-chemical corrosion process. In still another exemplary mechanism, the deposited molecules form a hydrophobic molecular layer that inhibits water from reaching the metal surface and forming the electrolyte necessary for corrosion reactions. In view of these inhibiting mechanisms, the exemplary protective snap cap devices 100, 200 and 400 advantageously shield against rust, tarnish, and corrosion.

In some particular, non-limiting embodiments, the protective material of the exemplary snap cap devices 100, 200 and 400 is provided by use of a powder, pellets, plugs, etc. that includes the protective material. In such configurations, the hollow interiors 108, 208, 422 of snap cap bodies 102, 202, 402 are filled with the vapor corrosion-inhibiting powder. The front ends 104, 204, 404 of snap cap bodies 102, 202, 402 can be configured to receive a vented plug (not shown) which at least partially seals off the hollow interiors 108, 208, 422 and prevents the vapor corrosion-inhibiting powder from spilling out of the hollow interiors.

As mentioned above with regard to snap cap devices 100 and 400 illustrated in FIGS. 1A-1B, 3A-3B, and 4-7, any corrosion protection molecules escaping out of the hollow interior 108 and 422 and through the plug is permitted to travel back and forth along the one or more surface grooves 120, 405 formed on the sides of the snap cap body, such that the corrosion protection molecules can reach both the front and back of an associated firearm, such as firearm 302 pictured in FIG. 3C.

As mentioned above with regard to snap cap device 200 as illustrated in FIGS. 2A-2B, the corrosion protection molecules can escape out of the hollow interior 208 through both the vented plug and the one or more vent holes 120, such that the corrosion protection molecules can reach both the front and back of an associated firearm. Moreover, although firearm 302 pictured in FIG. 3C is shown as including two snap cap bodies 102*a*, 102*b* configured similarly to snap cap body 102, it should be understood that a snap cap body configured similarly to snap cap body 202 or 402 could similarly be used without departing from the scope of the present disclosure.

In some other non-limiting embodiments, the protective material on the snap cap devices 100, 200 and 400 is provided by use of a barrier film infused or impregnated with the protective material. The film (not shown) can be used to at least partially cover the exterior profile of the bodies of the snap cap devices 100, 200 and 400. The film can be made from any suitable material that can be impregnated with the protective material. For example, the film can be made from plastics such as low-density polyethylene (LDPE) or metals such as aluminum. However, the particular material from which the barrier film is made is non-limiting. In such configurations, the bodies of the snap cap devices 100, 200 and 400 can be made from the same or different material as the barrier film, and can be provided with or without their respective hollow interior regions 108, 208, 422. Exemplary barrier film products having the vapor corrosion inhibiting substance are commercially available from Zerust®.

In other non-limiting embodiments, the protective material on the snap cap devices 100, 200 and 400 is provided by use of a coating that includes the protective material. In such configurations, the coating is applied to the exterior surface of the bodies of the snap cap devices 100, 200 and 400. In such an embodiment, the bodies of the snap cap devices 100, 200 and 400 can be made from any suitable material (e.g., plastic, metal, ceramic, composite material, wood, etc.) that is able to be coated and/or impregnated with the coating material. In such configurations, the bodies of the snap cap devices 100, 200 and 400 can be provided with or without their respective hollow interior regions 108, 208, 422. The coating that includes the protective material can be water-based, grease-based, oil-based, etc., without departing from the scope of the present disclosure. Exemplary coating products having the vapor corrosion-inhibiting substance are commercially available from Zerust®.

In still further non-limiting embodiments, the exemplary snap cap devices 100, 200 and 400 are provided with rust, corrosion, and tarnish protection by forming the bodies of the snap cap devices 100, 200 and 400 from a raw material which is infused or impregnated with or is mixed with the protective material. For example, the bodies of the snap cap devices 100, 200 and 400 can be made from a plastic or metal raw materials which have been previously impregnated with the protective material. Exemplary raw materials having the vapor corrosion inhibiting substance are commercially available from Zerust®. In some embodiments, the bodies of the snap cap devices 100, 200 and 400 are at least partially formed of a plastic material such as, but not limited to, polypropylene. The Zerust® substance may be molded with the plastic material, e.g., polypropylene, to form the material of the bodies of the snap cap devices 100, 200 and 400. In some embodiments, the Zerust® material is from about 0.5 wt. % to about 5 wt. % (and all values and ranges therebetween) of the composition of the material that is used to form the bodies of the snap cap devices 100, 200 and 400.

It should be understood from the present disclosure that the particular dimensions of the bodies of the snap cap devices 100, 200 and 400 are non-limiting. For example, a length and width of the bodies of the snap cap devices 100, 200 and 400 can be sized according to the caliber of an associated firearm in which the snap cap body will be installed. In this regard, the exemplary snap cap bodies disclosed herein can be dimensioned to fit within any number of different caliber firearm types, including but not limited to the twenty-two long rifle (.22 LR), three-eighty auto Colt pistol (.380 ACP) or 9 mm Short, 9 mm Luger or Parabellum, forty Smith & Wesson (.40 S&W), forty-five auto Colt pistol (.45 ACP), 10 mm, thirty-eight special (.38 Special), .357 Magnum, and 5.56×45 mm or .233 caliber rifle. Other exemplary caliber firearm types in which the exemplary snap cap bodies can be inserted include but are not limited to the: 2.34 mm rimfire, 2.7 mm Kolibri, 3 mm Kolibri, 4.25 mm Liliput (4.25 mm Erika), .17 Hornady Mach 2 (.17 HM2), .17 Hornady Magnum Rimfire (.17 HMR), .17-357 RG, 4.6×30 mm, 5 mm Clement Aut, 5 mm Bergmann Rimless, 5 mm Remington Rimfire Magnum, 5.45×18 mm, .22 BB, .22 CB, .22 Short, .22 Long, 22 Stinger (hot loading), .22 Remington Jet, .22 Reed Express (7.62×25 mm necked down to .22), .22 Winchester Magnum Rimfire, .224 Kay-Chuk, .221 Remington Fireball, .224 BOZ, .224 Montgomery, .224-32 FA (.327 Federal necked to .22), 5.7×28 mm, 5.5 mm Velo-Dog, 5.8×21 mm DAP92, .25 ACP (6.35 mm Browning, 6.35×16 mmSR), .25 NAA, .256 Winchester Magnum, 6.5 mm Bergmann, 7 mm Nambu (7×20 mm), 7.62 mm Nagant (7.62 mm Russian, 7.62×38 mmR), .32 Colt, .32 Protector, 7.65 mm Roth-Sauer, 7.65 mm Frommer, 7.62 mm Tokarev (7.62×25 mm), 7.62×42 mm SP-4, 7.65 mm Borchardt (.30 Borchardt), 7.65×22 mm Para (7.65×21 mm Luger, .30 Luger), 7.65 mm Mannlicher (7.65×21 mm), 7.63 mm Mauser (7.63×25 mm), .35 S&W Auto (.35 Auto), .32 ACP (7.65 mm Browning, 7.65×17 mmSR), 7.62×17 mm Type 64 (7.62 mm Chinese), 7.65 mm Longue (7.65 mm MAS), .30 Wildey (.30 Wildey Magnum), .32 NAA, .32 S&W, .32 S &W Long (.32 Colt New Police), 7.92×24 mm VBR (shortened .30 Carbine case), .32-20 Winchester (.32 WCF, .32-20 Marlin), .32 H&R Magnum, .327 Federal Magnum, .32 Short Colt, .32 Long Colt (.32 LC), .320 Revolver (.320 Bulldog, .320 Webley), 7.5 mm Swiss Army (7.5 mm 1882 Ordnance), 7.7 mm Bittner, 8 mm Rast-Gasser (8 mm Gasser), 8 mm Nambu, 8 mm Lebel Revolver (8 mm French Ordnance), 8 mm Pieper, 7.5 mm Nagant (7.5 mm Swedish Nagant), 8 mm Roth-Steyr, 8.5 mm Mars, 9 mm Japanese Revolver, 9 mm Ultra (9 mm Police, 9×18 mm), 9 mm Glisenti, 9 mm Parabellum (9 mm Luger, 9 mm NATO, 9×19 mm), 9 mm Federal (9×19 mmR), 9 mm Browning Long (9×20 mmSR), 9×21 mm (9 mm IMI), .356 TSW (9×21.5 mm), 9 mm Action Express (9 mm AE), .38-45 Auto (.45-38 Clerke, .45-38 Hard Head), 9 mm Steyr (9×23 mm Steyr), 9 mm Largo (9 mm Bergmann-Bayard, 9×23 mm), 9 mm Mauser (9×25 mm Mauser), 9 mm Dillon (9×25 mm Dillon), 9 mm Mauser (9×25 mm Mauser), 9 mm Winchester Magnum, .380 ACP (9 mm Kurz, 9 mm Short, 9×17 mm), 9×23 mm Winchester, .38 Casull, 9 mm Mars, .38 Short Colt, .38 Long Colt, .38 Special, .38 AMU (.38 Army Marksmanship Unit), .357 Peterbilt (.357 Wildey Magnum), .357 AutoMag (.357 AMP), .357-45 GWM (.357/45 Grizzly Winchester Magnum), .357/44 Bain & Davis, .357 Magnum (9×31 mmR, .353 Casull, .360 DW, .357 Remington Maximum (.357 Maximum), .357 SuperMag, .357 SIG, .38 ACP (.38 Auto, 9×23 mmSR), .38 Super, .38 Super Comp, .38 S&W (.38 Colt New Police, .380 Rim), 9 mm Makarov (9×18 mm PM), 9×21 mm Gyurza, .380 Revolver Short, .380 Revolver Long, British Webley pattern from 1860s, .375 SuperMag, 9.8 mm Auto Colt (9.65 mm Browning Automatic), .41 Long Colt (smokeless inside-lubricated variant), .40 S&W (.40 Auto, .40 Short, 10×22 mm), 10 mm Auto (10 mm Norma, 10×25 mm), 10 mm Magnum, .40 Super, .40 G&A, .40 G&A Magnum, .400 CorBon, .41 Short Colt, .41 Long Colt, .38-40 Winchester (.38-40 WCF), .401 Powermag (.401 Herter's Powermag), .41 Action Express (.41 AE), .41 Avenger, .41 Wildey Magnum (10 mm Wildey Magnum), .41 Special, .41 Remington Magnum (.41 Magnum), .414 SuperMag, 10.4 mm Italian (10.4 mm Italian Ordnance), 10.4 mm Swiss (.41 Swiss), .44 Russian (.44 Smith & Wesson Russian), .44 Special (.44 S&W Special), .44 Magnum (.44 Remington Magnum), .44-40 Winchester (.44 WCF), .445 SuperMag, .440 Cor-bon, .44 Wildey Magnum (11 mm Wildey Magnum), .44 AMP (.44 AutoMag), .44 S&W American (.44 American), .442 Webley (.442 Kurz, 10.5×17 mmR), .44 Bull Dog, .44 Colt, 11.75 mm Montenegrin (11 mm Gasser, 11.25×36 mm), 11.35 mm Schouboe (11.35×18 mm, .45 Schouboe), 11 mm French Ordnance, 11 mm German Service (10.6 mm GS, 10.8 mm GS), .460 Rowland, .45 Winchester Magnum (.45 WinMag, .45 NAACO), .450 Magnum Express, .45 Webley, .45 Auto Rim (.45 Automatic Rimmed), .45 GAP (.45 Glock), .45 HP (.45 Hirtenberger Patrone, .45 Italian), .45 ACP (.45 Auto, 11.43×23 mm), .45 Super, .450 SMC (.450 Short Magnum Cartridge), .45 Wildey Magnum, .451 Detonics (.451 Detonics Magnum), .454 Casull (.45 Magnum), .455 SuperMag, .460 S&W Magnum, .455 Webley (.455 Webley Revolver), .45 Schofield (.45 Smith & Wesson), .45 Colt Government, .45 Long Colt (.45 Colt), .45 Mars Short, .45 Mars Long, .450 Adams (.450 Boxer, .450 Corto), .455 Webley Auto, .455 Revolver Mk I (.455 Colt), .476 Enfield (.476 Eley, .476 Revolver, .455/476), .480 Ruger, .475 Wildey Magnum, .475 Linebaugh, .475 Linebaugh Long (.475 Maximum), 12.3×22 mm (Udar revolver cartridge), 12.3×40 mm (STs-110) (Udar revolver cartridge), 12.3×50 mm (Udar revolver cartridge), .50 GI, .50 Action Express (.50 AE), .500 Wyoming Express (.500 WE), .500 JRH, .500 S&W Special, .500 S&W Magnum, .50 Remington, .50 Special (.50 Bowen Special), .500 Linebaugh, .500 Linebaugh Long (.500 Maximum), .505 SuperMag (.510 SuperMag), 13 mm Gyrojet, and .577 Boxer (.577 Eley, .577 Webley).

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall there between. The invention has been described with reference to the preferred embodiments. These and other modifications of the preferred embodiments as well as other embodiments of the invention will be obvious from the disclosure herein, whereby the foregoing descriptive matter is to be interpreted merely as illustrative of the invention and not as a limitation. It is intended to include all such modifications and alterations insofar as they come within the scope of the appended claims.

What is claimed:

1. A snap cap device configured to release corrosion protection molecules to protect firearms, said snap cap device comprising a snap cap body and a plug, said snap cap body including a first and a second end, said first end configured to be inserted into a barrel or chamber of a firearm, said second end includes a flange or wall configured to inhibit or prevent said second end from being fully inserted into the barrel or chamber of the firearm, said snap cap body including a cavity that is connected to a first end opening located at a first end of said snap cap body, said plug connected to said first end, said snap cap device including a protective material that includes or is formed of a material that releases said corrosion protection molecules, said protective member in the form of a powder, pellet, and/or a protective member plug located in said cavity and at least partially retained in said cavity by said plug, said protective material a) included in a material used to at least partially form said snap cap body, b) included in and/or on a film material that is secured to one or more portions said snap cap body, c) included in a coating material that is coated on one or more portions of said snap cap body, d) inserted into a cavity in said snap cap body, and/or e) included in a material used to at least partially form a plug that is connected to said snap cap body.

2. The snap cap device as defined in claim 1, wherein said snap cap body has a length that is greater than a width of said snap cap body.

3. The snap cap device as defined in claim 1, wherein said snap cap body includes a surface feature on an exterior surface wall of said snap cap body, said surface feature including a recess portion or groove that extends 50-100% a longitudinal length of said snap cap body.

4. A snap cap device configured to release corrosion protection molecules to protect firearms, said snap cap device comprising a snap cap body, said snap cap body including a first and a second end, said first end configured to be inserted into a barrel or chamber of a firearm, said second end including a flange or wall configured to inhibit or prevent said second end from being fully inserted into the barrel or chamber of the firearm, a said second end of said snap cap body including an opening that includes a strike wall component, said snap cap device including a protective material that includes or is formed of a material that releases said corrosion protection molecules, said protective material a) included in a material used to at least partially form said snap cap body, b) included in and/or on a film material that is secured to one or more portions of said snap cap body, c) included in a coating material that is coated on one or more portions of said snap cap body, d) inserted into a cavity in said snap cap body, and/or e) included in a material used to at least partially form a plug that is connected to said snap cap body.

5. The snap cap device as defined of claim 1, wherein the snap cap body further comprises one or more surface features on an exterior surface wall.

6. The snap cap device as defined in claim 1, wherein a second end of said snap cap body includes one or more openings.

7. The snap cap device as defined in claim 1, wherein said plug is threadedly connected to said first end.

8. The snap cap device as defined in claim 1, wherein said plug includes one or more openings.

9. A snap cap device configured to release corrosion protection molecules to protect firearms, said snap cap device comprising a snap cap body, said snap cap body including a first and a second end, said first end configured to be inserted into a barrel or chamber of a firearm, the snap cap body including an upper cap body that is connected to the snap cap base, said upper cap body is formed of a different material from said snap cap base, said second end including a flange or wall configured to inhibit or prevent said second end from being fully inserted into the barrel or chamber of the firearm, said snap cap device including a protective material that includes or is formed of a material that releases said corrosion protection molecules, said protective material a) included in a material used to at least partially form Said snap cap body, b) included in and/or on a film material that is secured to one or more portions of said snap cap body, c) included in a coating material that is coated on one or more portions of said snap cap body, d) inserted into a cavity in said snap cap body, and/or e) included in a material used to at least partially form a plug that is connected to said snap cap body.

10. The snap cap device as defined in claim 9, wherein the snap cap body is irremovably connected said snap cap base.

11. A snap cap device configured to release corrosion protection molecules to protect firearms, said snap cap device comprising a snap cap body, said snap cap body including a first and a second end, said first end configured to be inserted into a barrel or chamber of a firearm, said snap cap body including a time indicator arrangement, said time indicator arrangement including a time indicator panel, said second end including a flange or wall configured to inhibit or prevent said second end from being fully inserted into the barrel or chamber of the firearm, said snap cap device including a protective material that includes or is formed of a material that releases said corrosion protection molecules, said protective material a) included in a material used to at least partially form said snap cap body, b) included in and/or on a film material that is secured to one or more portions of said snap cap body, c) included in a coating material that is coated on one or more portions of said snap cap body, d) inserted into a cavity in said snap cap body, and/or e) included in a material used to at least partially form a plug that is connected to said snap cap body.

12. The snap cap device as defined in claim 11, wherein said time indicator panel includes time information in the form of date information and/or seasonal information.

13. A method for reducing oxidation and/or corrosion of a firearm comprising:

a. providing a snap cap device configured to release corrosion protection molecules to protect firearms, said snap cap device comprising a snap cap body, said snap cap body including a first and a second end, said first end configured to be inserted into a barrel or chamber of a firearm, said second end including a flange or wall configured to inhibit or prevent said second end from being fully inserted into the barrel or chamber of the firearm, said second end of said snap cap body includes an opening that includes a strike wall component, said snap cap device including a protective material that includes or is formed of a material that releases said corrosion protection molecules, said protective material is a) included in a material used to at least partially form said snap cap body, b) included in and/or on a film material that is secured to one or more portions of said snap cap body, c) included in a coating material that is coated on one or more portions of said snap cap body, d) inserted into a cavity in said snap cap body, and/or e) included in a material used to at least partially form a plug that is connected to said snap cap body; and, b. at least partially inserting said snap cap device into the barrel or chamber of the firearm and enabling corrosion protection molecules from said protective material to protect the firearm.

14. The method as defined in claim 13, wherein said snap cap body includes a surface feature on an exterior surface wall of said snap cap body, said surface feature including a recess portion or groove, and further including the step of enabling said corrosion protection molecules to flow about said exterior surface wall and along said surface feature so that said corrosion protection molecules can flow from both ends of said snap cap body.

15. The method as defined in claim 13, wherein a second end of said snap cap body includes one or more openings.

16. A method for reducing oxidation and/or corrosion of a firearm, said method comprises:

a. providing a snap cap device configured a to release corrosion protection molecules to protect firearms, said snap cap device comprising a snap cap body and a plug, said snap cap body including a first and a second end, said first end configured to be inserted into a barrel or chamber of a firearm, said second end including a flange or wall configured to inhibit or prevent said second end from being fully inserted into the barrel or chamber of the firearm, said snap cap body includes a cavity that is connected to a first end opening located at a first end of said snap cap body, said plug connected to said first end, said snap cap device including a protective material that includes or is formed of a material that releases said corrosion protection molecules, said protective member is in the form of a powder, pellet and/or plug that is located in said cavity and at least partially retained in said cavity by said plug, said protective material is a) included in a material used to at least partially form said snap cap body, b) included in and/or on a film material that is secured to one or more portions of said snap cap body, c) included in a coating material that is coated on one or more portions of said snap cap body, d) inserted into a cavity in said snap cap body, and/or e) included in a material used to at least partially form a plug that is connected to said snap cap body; and, b. at least partially inserting said snap cap device into the barrel or chamber of the firearm and enabling corrosion protection molecules from said protective material to protect the firearm.

17. The method as defined in claim 16, wherein said plug is threadedly connected to said first end.

18. A method for reducing oxidation and/or corrosion of a firearm, said method comprises:

a. providing a snap cap device configured to release corrosion protection molecules to protect firearms, said snap cap device comprising a snap cap body, the snap cap body includes an upper cap body that is connected snap cap base, said upper cap body is formed of a different material from said snap cap base, said snap cap body including a first and a second end, said first end configured to be inserted into a barrel or chamber of a firearm, said second end including a flange or wall configured to inhibit or prevent said second end from being fully inserted into the barrel or chamber of the firearm, said snap cap device including a protective material that includes or is formed of a material that releases said corrosion protection molecules, said protective material is a) included in a material used to at least partially form said snap cap body, b) included in and/or on a film material that is secured to one or more portions of said snap cap body, c) included in a coating material that is coated on one or more portions of said snap cap body, d) inserted into a cavity in said snap cap body, and/or e) included in a material used to at least partially form a plug that is connected to said snap cap body; and, b. at least partially inserting said snap cap device into the barrel or chamber of the firearm and enabling corrosion protection molecules from said protective material to protect the firearm.

19. A method for reducing oxidation and/or corrosion of a firearm comprising:

a. providing a snap cap device configured to release corrosion protection molecules to protect firearms, said snap cap device comprising a snap cap body, said snap cap body including a first and a second end, said first end configured to be inserted into a barrel or chamber of a firearm, said snap cap body including a time indicator arrangement, said time indicator arrangement including a time indicator panel, said second end includes a flange or wall configured to inhibit or prevent said second end from being fully inserted into the barrel or chamber of the firearm, said snap cap device including a protective material that includes or is formed of a material that releases said corrosion protection molecules, said protective material is a) included in a material used to at least partially form said snap cap body, b) included in and/or on a film material secured to one or more portions said snap cap body, c) included in a coating material coated on one or more portions of said snap cap body, d) inserted into a cavity in said snap cap body, and/or e) included in a material to at least partially form a plug connected to said snap cap body; and, b. at least partially inserting said snap cap device into the barrel or chamber of the firearm and enabling corrosion protection molecules from said protective material to protect the firearm.

20. The method as defined in claim 19, wherein said time indicator arrangement includes a recess portion in said snap cap body and a time indicator panel, said time indicator panel including time information the form of date information and/or seasonal information.

21. The method as defined in claim 20, further including the step of punching openings in said time indicator panel to indicate a time period during which said snap cap device was used with said firearm.

* * * * *